United States Patent [19]

Imazu et al.

[11] Patent Number: 5,072,605

[45] Date of Patent: Dec. 17, 1991

[54] PROCESS FOR PRODUCTION OF COVERED DEEP-DRAWN CAN

[75] Inventors: Katsuhiro Imazu; Masanori Aizawa, both of Yokohama; Tetsuo Miyazawa, Ayase; Nobuyuki Satoh, Ebina; Seishichi Kobayashi, Yokohama, all of Japan

[73] Assignee: Toyo Seikan Kaisha Ltd., Tokyo, Japan

[21] Appl. No.: 538,044

[22] Filed: Jun. 13, 1990

[30] Foreign Application Priority Data

Jun. 13, 1989 [JP] Japan ..... 1-148285

[51] Int. Cl.[5] ..... B21B 45/00

[52] U.S. Cl. ..... 72/46; 72/347

[58] Field of Search ..... 72/46, 347, 349; 118/503; 264/235, 346

[56] References Cited

U.S. PATENT DOCUMENTS 3,564,895 2/1971 Pfanner et al. ..... 72/351

4,415,523 11/1983 Barham et al. ..... 264/346

4,450,977 5/1984 Culburn et al. ..... 72/46

*Primary Examiner*—Lowell A. Larson

*Assistant Examiner*—Michael J. McKeon

*Attorney, Agent, or Firm*—Sughrue, Mion, Zinn, Macpeak & Seas

[57] ABSTRACT

Disclosed is a process for the production of a covered deep-drawn can, which comprises subjecting a metal sheet covered with a thermoplastic resin to drawing and deep-drawing. By heat-treating the formed covered deep-drawn can at a temperature higher than the glass transition point of the thermoplastic resin covering but lower than the melting point of the thermoplastic resin covering, the corrosion resistance, heat resistance and denting resistance of the can are improved, and the adhesion of the resin covering to the metal sheet and the heat resistance of the resin covering to the metal sheet and the heat resistance of the resin covering are improved without degradation of film characteristics inherently possessed by the resin covering.

12 Claims, 4 Drawing Sheets

(NON-HEAT TREATED)

(HEAT-TREATED AT 220°C FOR 1 MINUTE)

PROCESS FOR PRODUCTION OF COVERED DEEP-DRAWN CAN

BACKGROUND OF THE INVENTION (1) Field of the Invention

The present invention relates to a process for the production of a covered deep-drawn can. More particularly, the present invention relates to a process for the production of a covered deep-drawn can which is excellent in the adhesion of the covering and the corrosion resistance, heat resistance and denting resistance.

(2) Description of the Related Art

As the process for the preparation of a side-seamless can, there is known a process comprising subjecting a metal blank such as an aluminum sheet, a tin-plate sheet or a tin-free steel sheet to a drawing operation of at least one stage between a drawing die and a punch to form a cup comprising a barrel having no seam on the side and a bottom integrally connected seamlessly to the barrel, and if desired, subjecting the barrel of the cup to an ironing processing between an ironing punch and an ironing die to reduce the thickness of the barrel. It also is known that a laminate formed by laminating a film of a thermoplastic resin such as polypropylene or a thermoplastic polyester is used in the production of this side-seamless can. Japanese Examinated Patent Publication No. 59-35344 and Japanese Examined Patent No. 61-22626 teach that in order to moderate the internal stress generated in a covering resin layer at the drawing or deep-drawing (redrawing) step, the formed vessel is heated at a temperature close to the melting point of the resin and is then cooled.

According to this conventional technique, the molecular orientation imposed on the resin film layer at the drawing or deep-drawing processing of the laminate blank is moderated and the resin is rendered amorphous, whereby the adhesion of the resin layer to the metal substrate is improved. However, this method is defective in that the corrosion resistance or heat resistance of the obtained can body is still insufficient.

It is known that in a thermoplastic resin film, the barrier property to a corrosive component is higher as the molecular orientation or crystallization degree of the resin is higher, and that also the mechanical properties such as the strength and impact resistance are higher as the molecular orientation degree of the resin is higher. Accordingly, if the molecular orientation is moderated and the resin is rendered amorphous as proposed in the above-mentioned conventional technique, this results in degradation of these characteristics of the molecularly oriented resin.

Furthermore, in case of a crystalline thermoplastic resin such as polyethylene terephthalate, bad influences are brought about by the heat crystallization. For example, in a resin covering as mentioned above, heat crystallization (spherulitization) is caused at a cansterilization temperature, and the characteristics of the covering are drastically degraded.

SUMMARY OF THE INVENTION

It is therefore a primary object of the present invention to provide a process for preparing a covered deep-drawn can by drawing or deep-drawing a thermoplastic resin-covered metal sheet, in which a covered deep-drawn can having an improved adhesion of the resin covering and having improved corrosion resistance, heat resistance and denting resistance of the can is prepared.

Another object of the present invention is to provide a process for the production of a covered deep-drawn can, in which the adhesion of the resin covering to the metal sheet is improved without degradation of film characteristics inherently possessed by the resin covering and the heat resistance of the resin covering is improved.

More specifically, in accordance with the present invention, there is provided a process for the production of a covered deep-drawn can, which comprises covering a metal sheet with an orientable thermoplastic resin and subjecting the covered metal sheet to drawing and deep drawing, wherein the formed covered deep-drawn cup is heat-treated at a temperature higher than the glass transition point of the thermoplastic resin covering but lower than the melting point of the thermoplastic resin covering.

In the present invention, it is preferred that the heat treatment of the covered deep-drawn cup be carried out in the state where deformation of the open end, formed by deep-drawing, of the thermoplastic resin covering is restrained, and the thermoplastic resin covering be a biaxially molecularly oriented film composed mainly of ethylene terephthalate units.

According to the present invention, a metal sheet is covered with a thermoplastic resin and the covered metal sheet is subjected to drawing and deep drawing to form a covered deep-drawn can, and the present invention is prominently characterized in that the formed covered deep-drawn cup is heat-treated at a temperature higher than the glass transition point of the thermoplastic resin covering but lower than the melting point of the thermoplastic resin covering.

According to the present invention, by the heat treatment conducted at the above-mentioned temperature, the resin layer drawn and molecularly oriented by drawing and redrawing is fixed to the metal cup and is thermally set in the restrained state. Namely, by this heat treatment, the internal strain is removed, the crystallization degree is increased and bonding sites are activated without moderation of the molecular orientation of the resin layer.

In FIGS. 1-A and 1-B of the accompanying drawings, there are plotted the results of the measurement of the adhesion strength (kg/5 mm) at respective height positions of cans formed in Example 1 and Comparative Example 1 given hereinafter by deep-drawing a TFS (tin-free steel) sheet laminated with a biaxially drawn film of polyethylene terephthalate (PET) in the non-heat-treated state (FIG. 1-A) and after the heat treatment at 220° C. for 1 minute (FIG. 1-B). From these results, it is seen that if drawing or deep drawing forming is carried out, the adhesion strength in the upper portion of the can barrel is drastically reduced to a level lower than 0.05 kg/5 mm, and in contrast, if the heat treatment of the present invention is carried out, the adhesion strength is increased to a level more than 2 times as high as the level in the non-heat-treated state.

In the process of the present invention, the adhesion strength is highly improved by the heat treatment conducted at a temperature considerably lower than the melting point of the resin. It is deemed that this improvement will probably be due to moderation of the internal strain by heat setting and activation of bonding sites by heat.

Furthermore, since the orientation crystallization degree is improved without moderation of the molecular orientation, the barrier property of the resin layer is improved, and in the covered deep-drawn can, the corrosion resistance is prominently improved and the heat resistance is improved. For example, spherulitization is not caused even under heating. Furthermore, even if the covered deep-drawn can is subjected to the denting test, cracking is not caused in the resin covering. Moreover, the covered deep-drawn can is advantageous in that the surface luster, that is, the gloss, is excellent.

In the present invention, if the heat treatment of the covered deep-drawn cup is carried out in the state where deformation of the open end, formed by the deep drawing, of the thermoplastic resin covering is restrained, the above-mentioned functions are manifested more effectively.

Namely, it is necessary that the heat treatment should be carried out in the state where the thermal shrinkage of the resin covering caused by the internal strain is restrained.

It is especially preferred that the heat treatment be carried out so that a blank holder plate portion formed by the deep drawing is integrated with the cup, because the bonding force is drastically increased. The reason for this increase of the bonding force has not completely been elucidated, but it is construed that since the degree of the deep drawing is low in the blank holder plate portion formed by the deep drawing, reduction of the bonding force between the metal sheet and the covering resin layer is low and the restraint of the resin layer at the heat setting is effectively accomplished, and that the corner portion present between the blank holder plate portion and the barrel exerts an effective function on the restraint and fixation of the resin layer.

The molecular orientation given to the covering resin layer at the drawing and deep drawing of the resincovered metal sheet is a monoaxial molecular orientation in the direction of the can height. Accordingly, if the barrel is heat-treated, this orientation is thermally set. Therefore, an unoriented film or a monoaxially or biaxially oriented film can be used as the covering resin layer. However, if a biaxially oriented film, especially a biaxially oriented film of a polyester composed mainly of ethylene terephthalate units, is used, several advantages not attainable by other films can be attained. In the first place, the degree of the orientation crystallization by the heat setting is increased in the barrel of the can. In the second place, the thermal crystallization of the resin layer of the bottom of the can, which is in the undrawn state, can be prevented.

DETAILED DESCRIPTION OF THE PREFERRED EMBODIMENTS

Figure 1A:
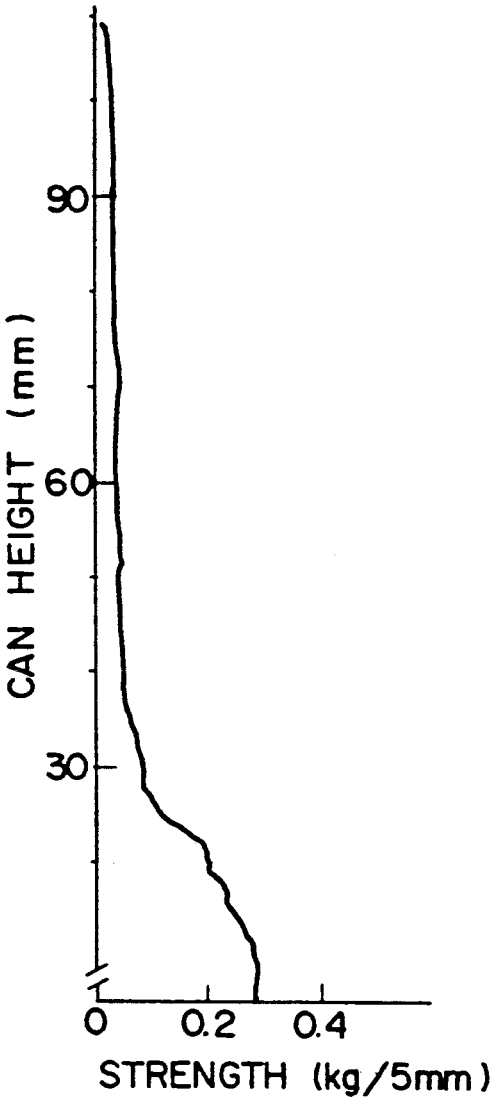
FIG. 1-A and 1-B are graphs showing the adhesion strength at respect positions in the height direction, determined in the non-heat-treated state (FIG. 1-A) and after the heat treatment at 220° C. for 1 minute (FIG. 1-B), with respect to a can formed by deep-drawing a laminate of a biaxially drawn film of polyethylene terephthalate and a tin-free steel sheet in Example 1 and Comparative Example 1.
Figure 1B:
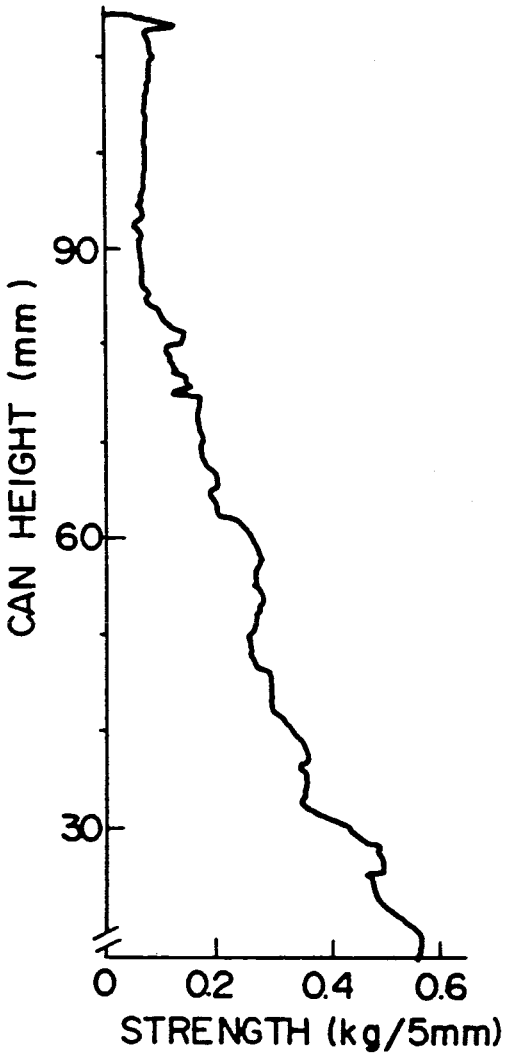
Figure 2:
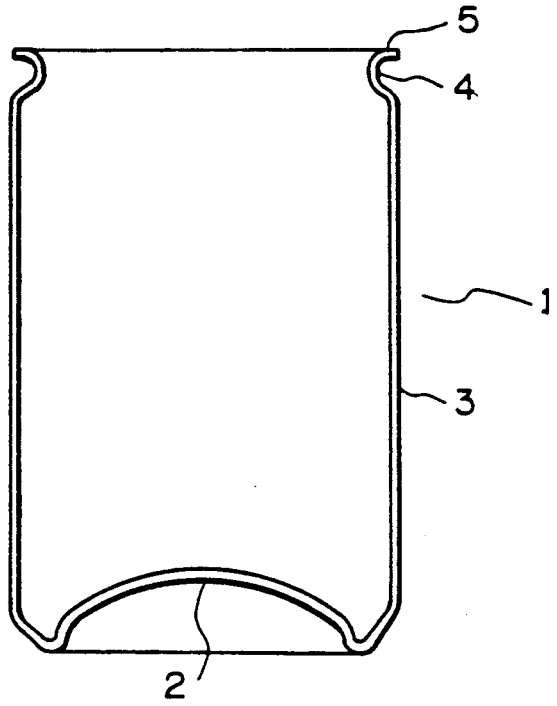
FIG. 2 is a sectional side view showing an example of the deep-drawn can obtained according to the present invention.

Referring to FIG. 2 illustrating an example of the deep-drawn can formed according to the present invention, this deep-drawn can 1 is formed by the deep drawing (drawing-redrawing) of an organic resin-covered metal sheet, and this deep-drawn can 1 comprises a bottom 2 and a side wall 3, and a flange 5 is formed on the top end of the side wall 3, if desired, through a neck 4. In this can 1, the thickness of the side wall 3 is generally reduced, as compared with the thickness of the bottom 2, by bending elongation or light ironing.

Figure 3:
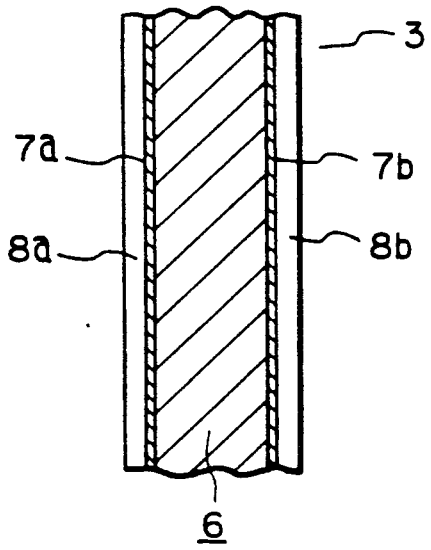
FIG. 3 is an enlarged sectional view showing the sectional structure of the side wall of the can shown in FIG. 2.

Referring to FIG. 3 illustrating an example of the sectional structure of the side wall 3, this side wall 3 comprises a metal substrate 6, an outer face layer 8*a* of an orientable thermoplastic resin formed on the outer face side of the metal substrate 6 through an adhesive primer or adhesive layer 7*a*, and an inner face layer 8*b* of an orientable thermoplastic resin formed on the inner face side of the metal substrate 6 through and adhesive primer or adhesive layer 76. These thermoplastic resins 8*a* and 8*b* are molecularly oriented and thermally set are bonded tightly to the metal substrate 6. The sectional structure of the bottom is the same as that of the barrel except that the entire thickness of the bottom 2 is a little larger than that of the barrel and the degree of the orientation of the resin layers 8*a* and 8*b* is a little lower than in the barrel.

Various surface-treated steel sheets and sheets of light metals such as aluminum can be used as the metal sheet in the present invention.

A surface-treated steel sheet prepared by annealing a cold-rolled steel sheet, subjecting the annealed steel sheet to secondary cold rolling and subjecting the steel sheet to at least one surface treatment selected from zinc deposition, tin deposition, nickel deposition, electrolytic chromate treatment and chromate treatment can be used as the surface-treated steel sheet. One preferred example of the surface-treated steel sheet is an electrolytically chromate-treated steel sheet, and an electrolytically chromate-treated steel sheet comprising 10 to 200 $mg/m^2$ of a metallic chromium layer and 1 to 50 $mg/m^2$ (calculated as metallic chromium) of a chromium oxide layer is especially preferably used. This chromate-treated steel sheet is especially excellent in the combination of the adhesion of the covering and the corrosion resistance. Another example of the surface-treated steel sheet is a hard tin-plate sheet having a deposited tin amount of 0.5 to 11.2 $g/m^2$. It is preferred that the tin-plate sheet be chromate-treated or chromate/phosphate-treated so that the chromium amount is 1 to 30 $mg/m^2$ as calculated as metallic chromium.

Still another example of the surface-treated steel sheet is an aluminum-covered steel sheet formed by deposition or press welding of aluminum.

As the light metal sheet, there can be used not only a so-called pure aluminum sheet but also an aluminum alloy sheet. An aluminum alloy sheet having excellent corrosion resistance and formability comprises 0.2 to 1.5% by weight of Mn, 0.8 to 5% by weight of Mg, 0.25 to 0.3% by weight of Zn and 0.15 to 0.25% by weight of Cu, with the balance being Al. It is preferred that the light metal sheet be chromate-treated or chromate/- phosphate-treated so that the amount of chromium is 20 to 300 mg/m$^2$ as calculated as metallic chromium.

The blank thickness, that is, the thickness ($t_B$) of the bottom, of the metal sheet depends on the kind of the metal and the intended use of the can, but in general, the blank thickness is preferably 0.10 to 0.50 mm. It is especially preferred that the blank thickness be 0.10 to 0.30 mm in case of a surface-treated steel sheet and 0.15 to 0.40 mm in case of a light metal sheet.

A molecularly orientable and crystalline thermoplastic resin is used for covering the metal sheet. For example, there can be used films of olefin resins such as polyethylene, polypropylene, an ethylene/propylene copolymer, an ethylene/vinyl-acetate copolymer, an ethylene/acrylic ester copolymer and an ionomer, films of polyesters such as polyethylene terephthalate, polybutylene terephthalate, an ethylene terephthalate/isophthalate copolymer, an ethylene terephthalate/adipate copolymer, an ethylene terephthalate/sebacate copolymer and a butylene terephthalate/isophthalate copolymer, films of polyamides such as nylon 6, nylon 6, 6, nylon 11 and nylon 12, polyvinyl chloride films, and polyvinylidene chloride films, so far as the above requirements are satisfied. These films may be undrawn or biaxially drawn. It is generally preferred that the thickness of the film be 3 to 50 μm, especially 5 to 48 μm.

All of the above-mentioned resin films can be used in the present invention, but a biaxially molecularly oriented film of a polyester composed mainly of ethylene terephthalate units is preferably used.

The degree of the orientation crystallization of the resin is determined by the density method and is calculated based on the density measured by a density gradient tube according to the following formula:

$$X_v = \frac{(\rho - \rho a)}{(\rho c - \rho a)} \times 100 \quad (1)$$

wherein $\rho$ represents the density of the resin sample, $\rho c$ represents the density of a completely crystallized product of the resin, and $\rho a$ represents the density of a completely amorphous product of the resin.

In case of polyethylene terephthalate, $\rho c$ is 1.455 g/cc and $\rho a$ is 1.335 g/cc. It is preferred that a biaxially drawn film of a polyester composed mainly of ethylene terephthalate units, used in the present invention, be molecularly oriented to such an extent that the value Xv is 5 to 65%, especially 10 to 60%. This film has a high nerve and shows an excellent workability at the laminating step.

The lamination of the film to the metal sheet is accomplished by the heat-fusion-bonding method, the dry lamination method and the extrusion coating method. If the adhesiveness (heat-fusion-bondability) between the film and metal sheet is poor, a urethane adhesive, epoxy adhesive, acid-modified olefin resin adhesive, copolyamide adhesive or copolyester adhesive or an adhesive primer described hereinafter can be interposed therebetween. A paint which is excellent in the adhesion to the metal sheet and the corrosion resistance and has an excellent adhesiveness to the resin film is used as the adhesive primer. As the adhesive primer, there can be used a paint comprising an epoxy resin and a curing agent resin for the epoxy resin, such as a phenolic resin, an amino resin, an acrylic resin or a vinyl resin, especially an epoxy/phenolic paint, and an organosol paint comprising a vinyl chloride resin or vinyl chloride copolymer resin and an epoxy resin paint.

The thickness of the adhesive primer or adhesive layer is preferably 0.1 to 5 μm, but the thickness is appropriately selected so that the molecular orientation of the thermoplastic resin is not hindered.

At the laminating step, an adhesive primer or adhesive layer is formed on one or both of the metal sheet and the film, and after the layer is dried or partially cured if necessary, the metal sheet and film are pressed and integrated under heating. Although it sometimes happens that the biaxial molecular orientation in the film is somewhat moderated during the laminating step, this moderation has no influence on the drawing/redrawing processing and the forming workability is sometimes improved by this moderation.

An inorganic filler (pigment) can be incorporated into the outer face film so as to hide the metal sheet and assist the propagation of the blank holder force to the metal sheet at the drawing/redrawing step.

As the inorganic filler, there can be mentioned inorganic white pigments such as rutile type titanium oxide, anatase type titanium oxide, zinc flower and gloss white, white extender pigments such as baryte, precipitated baryte sulfate, calcium carbonate, gypsum, precipitated silica, aerosil, talc, calcined clay, uncalcined clay, barium carbonate, alumina white, synthetic mica, natural mica, synthetic calcium silicate and magnesium carbonate, black pigments such as carbon black and magnetite, red pigments such as red iron oxide, yellow pigments such as sienna, and blue pigment such as ultramarine blue and cobalt blue. The inorganic filler can be incorporated in an amount of 10 to 500% by weight, especially 10 to 300% by weight, based on the resin.

Figure 4:
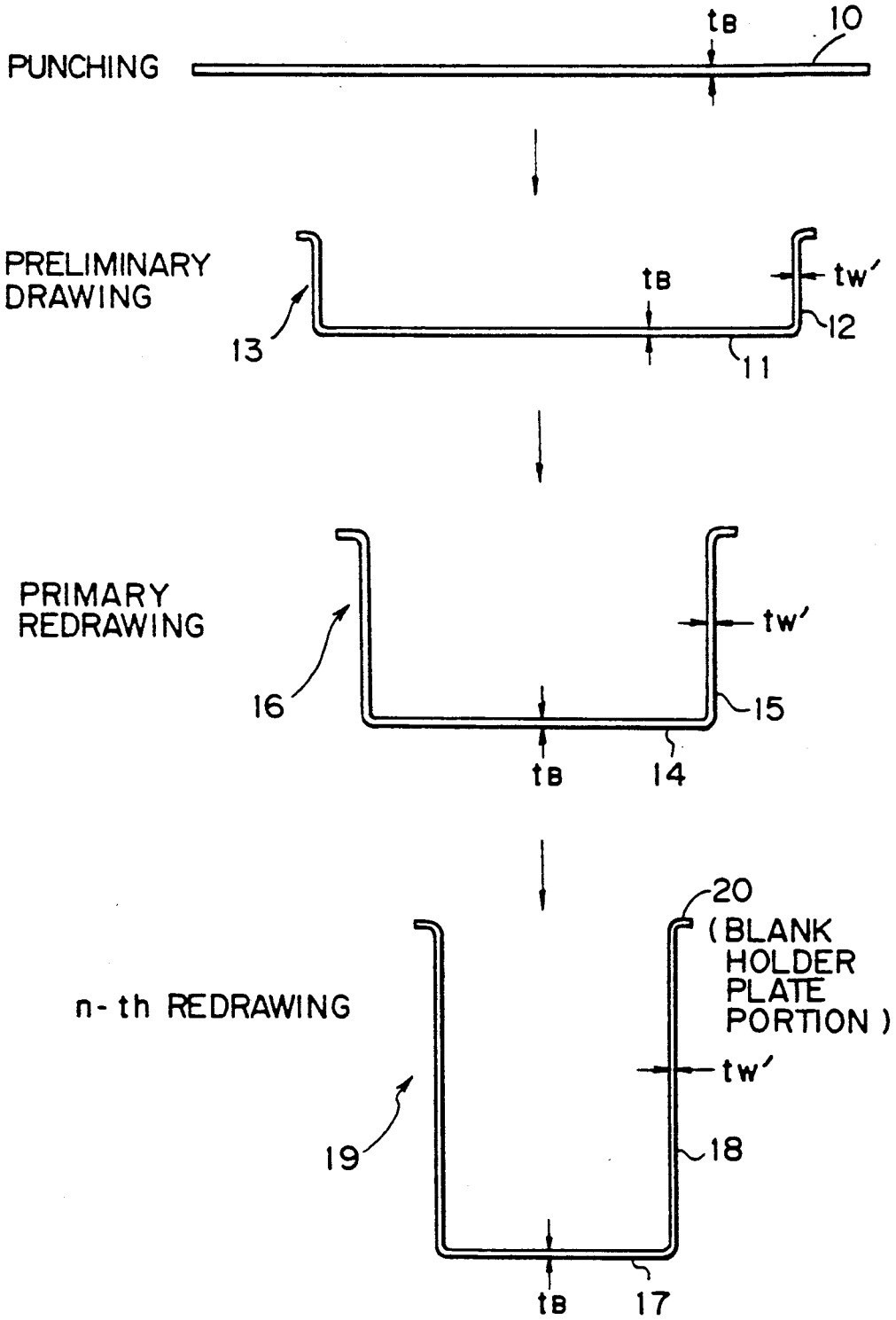
FIG. 4 is a diagram illustrating the drawing deep-drawing step.

As shown in FIG. 4, the drawing/deep-drawing processing comprises punching a covered metal sheet 10 into a disk, forming the disk into a preliminarily drawn cup 13 comprising a bottom 11 and a side wall 12 by using a preliminarily drawing punch having a large diameter and a die at the preliminarily drawing step, holding the preliminarily drawn cup 13 by an annular holding member inserted in the cup and a redrawing die (not shown), relatively moving the redrawing die and a redrawing punch capable of going into the holding member and going out therefrom coaxially with the holding member and redrawing die so that the redrawing punch and redrawing die are engaged with each other, to form the preliminarily drawn cup 13 into a deep-drawn cup 16 having a small diameter, and similarly forming the cup 16 into a cup 19 having a further reduced diameter.

Incidentally, reference numerals 14 and 17 represent bottoms of the cups 16 and 19, respectively, and reference numerals 15 and 18 represent side walls of the cups 16 and 19, respectively. At this redrawing step, it is preferred that the thickness be reduced by bending elongation of the covered metal sheet at an acting corner portion of the redrawing die, or the thickness be reduced be lightly ironing the covered metal sheet between the redrawing punch and redrawing die.

In general, the relation of $tw''' \leqq tw'' \leqq tw' \leqq t_B$ is established among the thicknesses of the side walls of the respective cups in FIG. 4.

It is preferred that the drawing ratio defined by the following formula:

$$\text{Drawing ratio} = (\text{diameter of blank})/(\text{diameter of punch}) \quad (2)$$

be 1.2 to 2.0, especially 1.3 to 1.9.

Furthermore, it is preferred that the redrawing ratio defined by the following formula:

$$\text{Redrawing ratio} = (\text{diameter of drawing punch})/(\text{diameter of redrawing punch}) \quad (3)$$

be 1.1 to 1.6, especially 1.15 to 1.5.

Moreover, it is preferred that the degree of the reduction of the thickness be such that the thickness of the side wall of the formed cup is 5 to 45%, especially about 5 to about 40%, of the blank thickness (the thickness of the bottom). Conditions causing the molecular orientation in the resing layer are preferably adopted at the drawing/redrawing forming, and for this purpose, it is preferred that the forming be carried out at a drawing temperature of the resin, for example, at a temperature of 40° to 200° C. in case of PET.

For the drawing/redrawing forming, it is preferred that the covered metal sheet or cup be coated with a lubricant such as liquid paraffin, synthetic paraffin, edible oil, hydrogeneted edible oil, palm oil, natural wax or polyethylene wax. The amount coated of the lubricant depends on the kind of the lubricant used, but it is generally preferred that the lubricant be coated in an amount of 0.1 to 10 mg/dm$^2$, especially 0.2 to 5 mg/dm$^2$. In general, the lubricant in the melted state is spray-coated on the surface of the covered metal sheet or cup.

In the present invention, the heat treatment of the covered deep-drawn cup is carried out in the state where deformation of the open end of the thermoplastic resin covering of the cup is restrained. Various methods can be adopted for restraining deformation of the open end of the thermoplastic resin covering according to the shape of the open end. For example, there can be adopted (1) a method in which the open end of a straight covered deep-drawn cup not provided with a blank holder plate portion 20 is held from the inner side and outer side by a pair of molds (see FIG. 5), and (2) a method in which a blank holder plate portion 20 integrated with the cup, which is formed by the drawing-/redrawing operation, is utilized as the deformation-restraining portion (see FIG. 4).

In the method (2), in order to attain a heat treatment effect stably, it is preferred that the blank holder plate portion of the covered drawn cup be formed so that the average length of the blank holder plate portion is at least 0.5 mm.

The obtained deep-drawn can is subjected to the heat treatment directly or after a post treatment such as water washing or drying. The heat treatment is carried out at a temperature higher than the glass transition point (Tg) of the resin but lower than the melting point (Tm) of the resin. In case of a PET film covering, the heat treatment is preferably carried out at a temperature of 70° to 240° C., especially 150° to 230° C. The orientation crystallization of the resin by the heat treatment requires a relatively short time at a high temperature or a long time at a low temperature. In the present invention, satisfactory results can be obtained if the heat treatment is carried out so that the density method crystallization degree represented by the above-mentioned formula (1) is 15 to 70%, especially 20 to 65%.

The heat treatment is accomplished by optional heating means such as an infrared ray heating furnance, a hot air circulating furnace, a flame heating method or a high-frequency induction heating method. The heat-treated covered deep-drawn can is formed into a can barrel for a two-piece can by carrying out trimming, printing, necking of one stage or a plurality of stages, flanging, beeding or other post processing according to need.

Of course, in the present invention, in the case where a restraining or blank holder plate portion is utilized, the heat treatment is accomplished by baking at the step of printing the outer surface.

As is apparent from the foregoing description, according to the present invention, by drawing and deep-drawing a resin-covered metal sheet and heat-treating the formed cup, the adhesion strength of the resin covering can be drastically increased, as compared with the adhesion strength of the resin covering in the untreated cup, and the orientation crystallization degree can be improved without moderation of the molecular orientation and the barrier property of the resin layer to corrosive components can be improved. Accordingly, the corrosion resistance of the covered deep-drawn can is prominently increased. Furthermore, the heat resistance is improved, and for example, spherulitization is not caused even under heating. Moreover, if the formed can is subjected to the denting test, cracking is not caused in the resin covering. Still further, the formed can is advantageous in that the surface luster, that is, the gloss, is excellent.

The present invention will now be described in detail with reference to the following examples that by no means limit the scope of the invention.

EXAMPLE 1

A polyethylene terephthalate (PET) film having a thickness of 20 μm, a glass transition temperature 70° C. and a melting point of 255° C. was heat-bonded to both of the surfaces of a tin-free steel (TFS) sheet having a blank thickness of 0.10 mm and a tempering degree of DR-9 to form a covered metal sheet. A lubricant was coated on both of the surfaces of the covered metal sheet and the metal sheet was subjected to drawing, redrawing and doming under conditions described below. The deep-drawn can was washed and heat-treated under conditions described below. Then, according to customary procedures, the can was degreased, washed and subjected to trimming, printing (baking at 205° C. for 2 minutes), necking and flanging to form a barrel for a two-piece can. The properties shown in Table 1 of the obtained barrel were evaluated. As the result, it was confirmed that the film properties of the resin covering were improved and a deep-drawn can having a good heat resistance and an excellent corrosion resistance was obtained.

FORMING CONDITIONS

A. Drawing (1) Temperature for heating covered metal sheet: 80° C.

(2) Blank diameter: 187 mm (3) Drawing ratio: 1.50

B. Redrawing (1) Temperature for heating covered metal cup: 80° C.

(2) Primary redrawing ratio: 1.29

(3) Secondary redrawing ratio: 1.24

(4) Third redrawing ratio: 1.20
(5) Average residual length of blank holder plate portion of final deep-drawn can: 2 mm

HEAT TREATMENT CONDITION (1) Temperature for heat treatment of covered metal cup: 220° C.
(2) Time for heat treatment of covered metal cup: 1 minute

EVALUATION

A. Adhesion strength

A drawn barrel was cut into a sample having a width of 4 mm in the can height direction, and the 90° -peel strength was measured and expressed per unit width.

B. Heat Resistance

The heat resistance was evaluated based on the presence or absence of peeling (delamination) of the covering resin layer after the heat treatment, the presence or absence of delamination of the covering resin layer after the printing step and the degree of the damage of the covering layer at the denting test.

C. Formability

The formability was evaluated based on the presence or absence of delamination and cracking of the covering resin layer at the necking processing and flanging processing.

D. Corrosion Resistance

The deep-drawn can was filled with cola (carbonated drink) and wrap-seamed and the filled can was stored for a long time at 37° C. Then, the corrosion state of the inner face of the can and the occurrence of leakage were checked.

EXAMPLE 2

Figure 5:
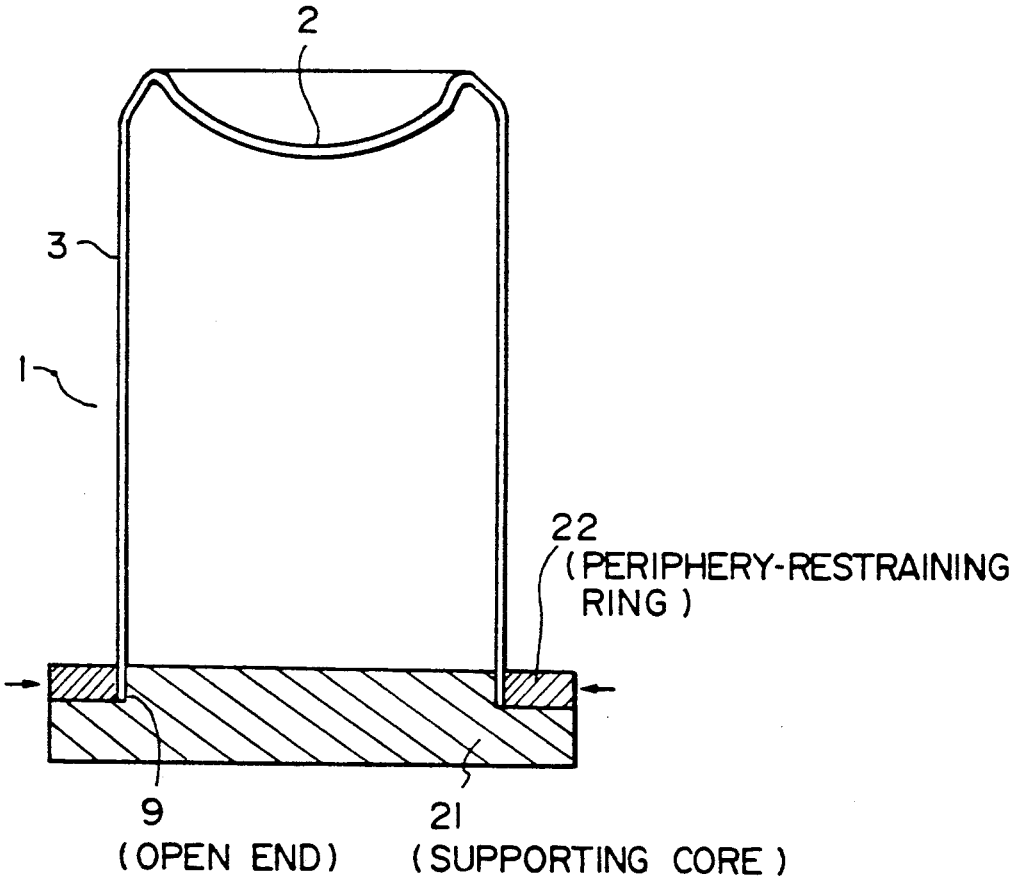
FIG. 5 is a diagram illustrating an example of the heat-treating step.

A deep-drawn can was prepared in the same manner as described in Example 1 except that the third redrawing was completely carried out to form a finally drawn can having no blank holder plate portion left and the deep-drawn can was subjected to doming, washed and then heat-treated by using a restraing tool as shown in FIG. 5. The obtained results are shown in Table 1. It is seen that the properties of the film were improved and a deep-drawn can having a good heat resistance and an excellent corrosion resistance could be obtained.

COMPARATIVE EXAMPLE 1

A deep-drawn can was prepared in the same manner as described in Example 1 except that the deep-drawn can obtained by redrawing was washed and naturally dried and the heat treatment was not carried out. The obtained results are shown in Table 1. Certain delamination of the covering resin layer was caused at the trimming edge portion at the printing step, and the deep-drawn can was not suitable as a vessel in the adhesion strength, heat resistance and corrosion resistance.

COMPARATIVE EXAMPLE 2

A deep-drawn can was prepared in the same manner as described in Example 1 except that the blank holder plate portion of the final deep-drawn can was trimmed to form a straight can barrel and then, the heat treatment was carried out.

The obtained results are shown in Table 1. Delamination of the covering resin layer was caused from the trimming edge portion at the heat treatment step and the can could not be subjected to subsequent processings (printing, necking and flanging.)

COMPARATIVE EXAMPLE 3

A deep-drawn can was prepared in the same manner as described in Example 1 except that the heat treatment temperature was changed to 280° C., that is, a temperature higher than the melting point of the covering resin layer (PET film. The obtained results are shown in Table 1. Delamination of the covering resin layer was caused from the trimming edge portion at the heat treatment step and the can could not be subjected to subsequent processings (printing, necking and flanging.)

EXAMPLE 3

A thickness-reduced deep-drawn can was prepared in the same manner as described in Example 1 except that the thickness of the side wall was reduced to 20% of the thickness of the bottom by performing bending stretching at the redrawing step. The obtained results are shown in Table 1. The film properties of the covering resin were improved and a thickness-reduced deep-drawn can having a good heat resistance and an excellent corrosion resistance could be obtained.

EXAMPLE 4

A deep-drawn can was prepared in the same manner as described in Example 1 except that an Al-Mg type aluminium alloy sheet having a blank thickness of 0.24 mm was used as the metal sheet.

The obtained results are shown in Table 1. A vessel having excellent adhesion strength, heat resistance and corrosion resistance was obtained.

EXAMPLE 5

An adhesive primer composed of an epoxy-phenolic paint was coated in a dry thickness of 1 μm on one surface of a polyethylene terephthalate/isophthalate film having a thickness of 20 μm, a glass transition temperature of 70° C. and a melting point of 240° C. The coated film was laminated on both of the surface of a tin-free steel (TFS) sheet having a blank thickness of 0.15 mm at 270° C. so that the primer-coated surface was contacted with the metal surface, whereby a covered metal sheet was obtained. A lubricant was coated on both of the surfaces of the covered metal sheet, and drawing, redrawing and doming were carried out in the same manner as described in Example 1. Then, the obtained deep-drawn can was washed and heat-treated at 225° C. for 30 seconds by the high-frequency induction heating method. Then, trimming, outer surface printing, necking and flanging were carried out to obtain a barrel for a two-piece can.

The obtained results are shown in Table 1. A vessel having excellent adhesion strength, heat resistance and corrosion resistance could be obtained.

EXAMPLE 6

The outer surface of the deep-drawn can which had been subjected to doming and washing in Example 1 was printed, and baking was carried out at 205° C. for 2 minutes. Then, trimming, necking and flanging were carried out to obtain a can body for a two-piece can. The properties of the can body were measured. The obtained results are shown in Table 1. It is seen that the film properties of the resin covering were improved and a deep-drawn can having a good heat resistance and an excellent corrosion resistance could be obtained.

TABLE 1

| | Coated Sheet | | | Drawing Step | Redrawing Step | | |
|---|---|---|---|---|---|---|---|
| | Substrate | innerface | outerface | tempera-ture | tempera-ture | thickness reduction ratio | average length of blank holder plate portion |
| Example 1 | TFS, 0.18 mm | PET | PET | 80° C. | 80° C. | 0% | 2 mm |
| Example 2 | TFS, 0.18 mm | PET | PET | " | " | " | 0 mm |
| Comparative Example 1 | TFS, 0.18 mm | " | " | " | " | " | 2 mm |
| Comparative Example 2 | TFS, 0.18 mm | " | " | " | " | " | 0 mm |
| Comparative Example 3 | TFS, 0.18 mm | " | " | " | " | " | 2 mm |
| Comparative Example 4 | TFS, 0.18 mm | " | " | " | " | " | 0 mm |
| Example 3 | TFS, 0.18 mm | " | " | " | " | 20% | 2 mm |
| Example 4 | aluminum, 0.24 mm | " | " | " | " | 0% | 2 mm |
| Example 5 | TFS, 0.15 mm | PET/I | PET/I | " | " | 20% | 2 mm |
| Example 6 | TFS, 0.18 mm | PET | PET | " | " | 0% | 2 mm |

| | Heat Treatment Step | | | Adhesion | | Formability | |
|---|---|---|---|---|---|---|---|
| | tempera-ture | time | restraining tool | Strength (kg/5 mm) | Heat Resistance | (necking, flanging) | Corrosion Resistance |
| Example 1 | 220° C. | 1 min | not used | 0.13–0.56 | no change | no change | no change |
| Example 2 | " | " | used | 0.15–0.55 | no change | no change | no change |
| Comparative Example 1 | not effected | not effected | not used | 0.05–0.25 | delamination at printing | enlarged delamination | pitting and leakage |
| Comparative Example 2 | 220° C. | 1 min | not used | measurement impossible | delamination at heat treatment | forming impossible | not evaluated |
| Comparative Example 3 | 280° C. | 1 min | not used | 0.10–0.60 | whitening of film | film cracking | pitting and leakage |
| Comparative Example 4 | 50° C. | 4 min | not used | measurement impossible | delamination at heat treatment | forming impossible | not evaluated |
| Example 3 | 220° C. | 1 min | not used | 0.13–0.60 | no change | no change | no change |
| Example 4 | 220° C. | 1 min | not used | 0.18–0.65 | no change | no change | no change |
| Example 5 | 225° C. | 30 sec | not used | 0.20–0.80 | no change | no change | no change |
| Example 6 | 205° C. | 2 min | not used | 0.10–0.40 | no change | no change | no change |

What is claimed is:

1. A process for the production of a covered deep-drawn can, which comprises covering a metal sheet with a thermoplastic resin and subjecting the covered metal sheet to drawing and deep drawing to form a covered deep-drawn cup having a blank portion integrated therewith, and heat treating the formed covered deep-drawn cup at a temperature higher than the glass transition point of the thermoplastic resin covering but lower than the melting point of the thermoplastic resin covering in a state wherein said blank holder plate portion formed by the deep-drawing is heat treated as an integral part of said cup.

2. A production process according to claim 1, wherein the thermoplastic resin covering is a biaxially molecularly oriented film of a polyester composed mainly of ethylene terephthalate units.

3. A production process according to claim 1, wherein the thermoplastic resin covers the metal sheet through an adhesive primer.

4. A production process according to claim 1, wherein the heat treating of the covered deep-drawn cup at a temperature higher than the glass transition point of the thermoplastic resin covering but lower than the melting point of the thermoplastic resin covering is so that the degree (Xv) of the orientation crystallization of the thermoplastic resin as defined by the following formula:

$$X_v = \frac{(\rho - \rho a)}{(\rho c - \rho a)} \times 100 \quad (1)$$

wherein $\rho$ represents the density in g/cc of the thermoplastic resin, $\rho c$ represents the density in g/cc for the completely crystallized thermoplastic resin, and $\rho a$ represents the density in g/cc of the completely amorphous thermoplastic resin is 5 to 65%.

5. A process for the production of a covered deep-drawn can, which comprises laminating a biaxially oriented film of a polyester composed mainly of ethylene terephthalate units to a metal sheet, subjecting the resultant laminate to drawing and deep-drawing to form a covered deep-drawn cup having a blank portion integrated therewith, and heat-treating the covered deep-drawn cup in a state wherein said blank holder plate portion formed by the deep-drawing is heat treated as an integral part of said cup at a temperature higher than the glass transition point of the polyester but lower than the melting point of the polyester so that the degree (Xv) of the orientation crystallization of the polyester defined by the following formula:

$$Xv = \frac{(\rho - \rho a)}{(\rho c - \rho a)} \times 100 \quad (1)$$

wherein $\rho$ represents the density in g/cc of the polyester sample, $\rho c$ represents the density of 1.455 g/cc for the completely crystallized polyester, and $\rho a$ represents the density of 1.335 g/cc for the completely amorphous polyester is 5 to 65%.

6. A process according to claim 5, wherein the heat treating is at a temperature of 150° to 230° C. so that the degree (Xv) of the orientation crystallization of the polyester is 10 to 60%.

7. A process according to claim 5, wherein the heat treating is in a state where the covering polyester layer at the open end of the deep-drawn cup is restrained.

8. A process according to claim 5, wherein the laminating of the polyester film to the metal sheet is by heat-fusion bonding.

9. A process according to claim 5, wherein the laminating of the polyester film to the metal sheet is by interposing an adhesive or an adhesive primer therebetween, and heat-fusion-bonding the polyester film to the metal sheet through the adhesive or the adhesive primer.

10. A process according to claim 5, wherein the metal sheet is an electrolytically chromate-treated steel sheet comprising 10 to 200 mg/m$^2$ of a metallic chromium layer and 1 to 50 mg/m$^2$, calculated as metallic chromium, of a chromium oxide layer.

11. A process according to claim 5, wherein the metal sheet is a hard tin-plate sheet having a deposited tin amount of 0.5 to 11.2 g/m$^2$, which is chromate-treated or chromate/phosphate-treated so that the chromium amount is 1 to 30 mg/m$^2$ as calculated as metallic chromium.

12. A process according to claim 5, wherein the metal sheet is an aluminum alloy sheet comprising 0.2 to 1.5% by weight of Mn, 0.8 to 5% by weight of Mg, 0.25 to 0.3% by weight of Zn and 0.15 to 0.25% by weight of Cu with the balance being Al, said sheet being chromate-treated or chromate/phosphate-treated so that the chromium amount is 20 to 300 mg/m$^2$, calculated as metallic chromium.

* * * * *